US010472890B2

(12) United States Patent
Gharib et al.

(10) Patent No.: US 10,472,890 B2
(45) Date of Patent: Nov. 12, 2019

(54) DRILLING APPARATUS WITH A UNITARY BEARING HOUSING

(71) Applicant: Halliburton Energy Services, Inc., Houston, TX (US)

(72) Inventors: Hossam Gharib, Edmonton (CA); Steven Park, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 129 days.

(21) Appl. No.: 15/562,109

(22) PCT Filed: May 8, 2015

(86) PCT No.: PCT/CA2015/000301

§ 371 (c)(1),
(2) Date: Sep. 27, 2017

(87) PCT Pub. No.: WO2016/179676

PCT Pub. Date: Nov. 17, 2016

(65) Prior Publication Data

US 2018/0073299 A1 Mar. 15, 2018

(51) Int. Cl.

| | |
|---|---|
| ***E21B 4/00*** | (2006.01) |
| ***E21B 7/06*** | (2006.01) |
| ***E21B 4/02*** | (2006.01) |

(52) U.S. Cl.

CPC ..... *E21B 4/003* (2013.01); *E21B 4/02* (2013.01); *E21B 7/067* (2013.01)

(58) Field of Classification Search

CPC . E21B 4/003; E21B 7/067; E21B 4/02; E21B 7/062; E21B 7/04; E21B 17/1078;

(Continued)

(56) References Cited

U.S. PATENT DOCUMENTS

| | | | |
|---|---|---|---|
| 4,511,193 | A | 4/1985 | Geczy |
| 4,560,014 | A | 12/1985 | Geczy |

(Continued)

FOREIGN PATENT DOCUMENTS

| | | | |
|---|---|---|---|
| CA | 2549500 | C | 12/2006 |
| CN | 2119534 | U | 10/1992 |

(Continued)

*Primary Examiner* — Wei Wang

(74) *Attorney, Agent, or Firm* — Terrence N. Kuharchuk; Parlee McLaws LLP; Craig W. Roddy

(57) ABSTRACT

A drilling apparatus having a drive section and a bearing section axially distal to the drive section. The bearing section includes a unitary bearing housing defining a bearing housing bore, a driveshaft received within the bearing housing bore and rotatable relative to the bearing housing, and a bearing assembly radially interposed between the bearing housing and the driveshaft for rotatably supporting the driveshaft within the bearing housing bore. The unitary bearing housing may be connected directly with a transmission housing. An axis intersection point between a primary axis of the drilling apparatus and the driveshaft axis may be axially located between a proximal bearing housing end and a distal bearing housing end. One or more stationary bearing components may be non-rotatably engaged with one or more sleeves which are non-rotatably engaged with the bearing housing.

22 Claims, 8 Drawing Sheets

(58) Field of Classification Search
CPC .. E21B 4/00; E21B 10/22; F16C 17/00; F16C 17/04; F16C 25/04; F16C 27/02; F16C 27/08; F16C 19/14; F16C 19/30; F16C 33/04; F01C 21/02
See application file for complete search history.

(56) References Cited

U.S. PATENT DOCUMENTS

| | | | | |
|---|---|---|---|---|
| 5,037,212 | A | 8/1991 | Justman et al. | |
| 6,092,610 | A * | 7/2000 | Kosmala | E21B 4/20 175/61 |
| 6,328,119 | B1 | 12/2001 | Gillis et al. | |
| 6,629,571 | B1 | 10/2003 | Downie | |
| 7,334,649 | B2 | 2/2008 | Chen et al. | |
| 7,549,487 | B2 | 6/2009 | LeBlanc et al. | |
| 7,743,654 | B2 | 6/2010 | Spross et al. | |
| 8,011,446 | B2 | 9/2011 | Wylie et al. | |
| 8,025,110 | B2 | 9/2011 | Falgout, Jr. et al. | |
| 8,141,658 | B2 | 3/2012 | Blair et al. | |
| 8,157,025 | B2 | 4/2012 | Johnson | |
| 8,721,182 | B2 | 5/2014 | Cioceanu | |
| 8,919,458 | B2 | 12/2014 | Plop | |
| 2006/0278439 | A1 | 12/2006 | Ide | |
| 2010/0215301 | A1 | 8/2010 | Wenzel | |
| 2012/0285748 | A1 | 11/2012 | Kirkhope | |
| 2012/0325561 | A1 | 12/2012 | LeBlanc et al. | |
| 2013/0213713 | A1 | 8/2013 | Smith et al. | |
| 2014/0138157 | A1 | 5/2014 | Heisig | |
| 2014/0209389 | A1 | 7/2014 | Sugiura et al. | |

FOREIGN PATENT DOCUMENTS

| | | | |
|---|---|---|---|
| CN | 102465667 | A | 5/2012 |
| CN | 203097709 | U | 7/2013 |
| CN | 104411912 | A | 3/2015 |
| WO | 2000036263 | | 6/2000 |
| WO | 2001049965 | A1 | 7/2001 |
| WO | 2011091500 | A1 | 8/2011 |
| WO | 2013173785 | A1 | 11/2013 |

* cited by examiner

DRILLING APPARATUS WITH A UNITARY BEARING HOUSING

TECHNICAL FIELD

A drilling apparatus having a bearing section with a unitary bearing housing.

BACKGROUND OF THE INVENTION

A drilling apparatus may include a drive section and a bearing section. The bearing section may be axially distal to the drive section. The bearing section may include a driveshaft rotatably supported within a bearing housing. The driveshaft may be driven by the drive section.

BRIEF DESCRIPTION OF DRAWINGS

Embodiments of the invention will now be described with reference to the accompanying drawings, in which.

DETAILED DESCRIPTION

Figure 1:
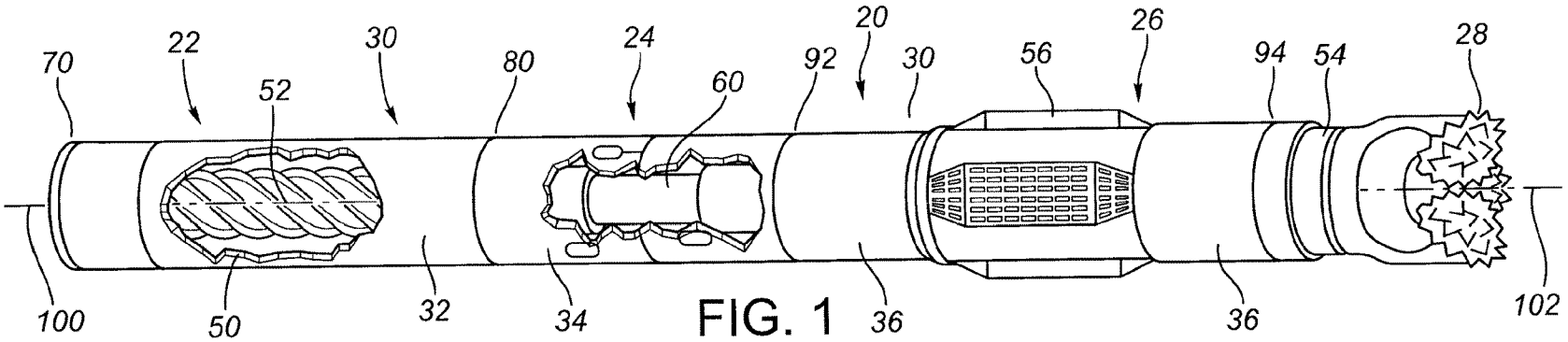
FIG. 1 is a partial cutaway pictorial view of components of a drilling apparatus.

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

References in this document to "proximal" means located relatively toward an intended "uphole" end, "upper" end and/or "surface" end of a borehole or of an apparatus or pipe string positioned in a borehole.

References in this document to "distal" means located relatively away from an intended "uphole" end, "upper" end and/or "surface" end of a borehole or of an apparatus or pipe string positioned in a borehole.

The present disclosure is directed at a drilling apparatus and at specific features of a drilling apparatus. In some embodiments, the drilling apparatus may be configured to be inserted and/or contained and/or used within a borehole. In some embodiments, the drilling apparatus may be used for drilling a borehole.

The drilling apparatus may comprise any apparatus which is suitable for drilling. In some particular embodiments, the drilling apparatus may comprise, consist of, or consist essentially of a rotary steerable apparatus for use in drilling a borehole. In some particular embodiments, the drilling apparatus may comprise, consist of, or consist essentially of a drilling motor for use in drilling a borehole.

In some embodiments, the drilling apparatus may comprise, consist of, or consist essentially of a positive displacement drilling motor. In some embodiments, the drilling apparatus may comprise, consist of, or consist essentially of a progressing cavity drilling motor, including but not limited to a Moineau-type progressing cavity motor.

The drilling apparatus may comprise a drive section and a bearing section. In some embodiments, the bearing section may be axially distal to the drive section.

The drive section provides drive energy for driving the drilling apparatus. The drive section may comprise any structure, device or apparatus which is capable of generating and/or transmitting drive energy to the bearing section of the drilling apparatus.

Drive energy may be both generated by and transmitted by the drive section to the bearing section, or drive energy may be generated elsewhere and transmitted by the drive section to the bearing section. In some embodiments, the drive energy may be rotational drive energy.

As a first non-limiting example, rotational drive energy for a rotary steerable drilling apparatus in a borehole may be generated by a motor at the surface of the borehole which rotates a drill string from the surface, and the drive section may transmit the rotational drive energy to the bearing section. As a second non-limiting example, rotational drive energy for a rotary steerable drilling apparatus in a borehole may be generated by a motor located in the borehole uphole of the rotary steerable drilling apparatus, and the drive section may transmit the rotational drive energy to the bearing section. As a third non-limiting example, rotational drive energy for a drilling motor may be generated by a power section of the drilling motor as the drive section, and the power section of the drilling motor may both generate the rotational drive energy and transmit the rotational drive energy to the bearing section.

In some embodiments, the drive section may comprise a drive member. The drive member may comprise any suitable structure or suitable combination of structures which is capable of transmitting drive energy to the bearing section. In some embodiments, the drive member may comprise a component of a drill string. In some embodiments, the drive member may comprise a structure which is connected directly or indirectly with a component of a drill string. In some embodiments, the drive member may comprise an output shaft of a drilling motor, including as a non-limiting example, a rotor in a drilling motor. In some embodiments, the drive member may comprise a structure which is connected directly or indirectly with an output shaft of a drilling motor.

In some embodiments, the drive section may comprise a drive housing. In some embodiments, the drive housing may comprise a plurality of drive housing components which may be connected in any suitable manner. In some embodiments, the drive housing may be a unitary drive housing which consists of a single drive housing component.

The drive housing may have a proximal drive housing end, a distal drive housing end, and a drive housing bore. In some embodiments, the drive member may be received within the drive housing. In some embodiments, the drive section may not require a drive housing.

In some embodiments, the drilling apparatus may comprise a transmission section. In some embodiments, the transmission section may be axially interposed between the drive section and the bearing section in order to provide a linkage between the drive section and the bearing section.

The transmission section may comprise any structure, device or apparatus which is capable of enabling the drive section to transmit drive energy from the drive section to the bearing section.

In some embodiments, the transmission section may comprise a transmission member. The transmission member may comprise any suitable structure or suitable combination of structures which is capable of transmitting drive energy to the bearing section. The transmission member may comprise a single transmission member component or may comprise a plurality of transmission member components. In some embodiments, the transmission member may comprise a substantially stiff shaft and one or more articulating connections. In some embodiments, the transmission member may comprise a flex shaft. In some embodiments, the transmission member may comprise a connector or simply a connection between a drive member and the bearing section.

In some embodiments, the transmission section may comprise a transmission housing. In some embodiments, the transmission housing may comprise a plurality of transmission housing components which may be connected in any suitable manner. In some embodiments, the transmission housing may be a unitary transmission housing which consists of a single transmission housing component.

The transmission housing may have a proximal transmission housing end, a distal transmission housing end, and a transmission housing bore. In some embodiments, the transmission member may be received within the transmission housing bore. In some embodiments, the transmission section may not require a transmission housing.

The bearing section may comprise a bearing housing, a driveshaft, and a bearing assembly.

The bearing housing may comprise any suitable structure or suitable combination of structures. In some embodiments, the bearing housing may comprise a plurality of bearing housing components which may be connected in any suitable manner. In some embodiments, the bearing housing may be a unitary bearing housing which consists of a single bearing housing component.

The bearing housing has a proximal bearing housing end and a distal bearing housing end. The bearing housing defines a bearing housing bore.

The driveshaft is received within the bearing housing bore and is rotatable relative to the bearing housing.

The driveshaft may comprise any suitable structure or suitable combination of structures. In some embodiments, the driveshaft may comprise a plurality of driveshaft components which may be connected in any suitable manner. In some embodiments, the driveshaft may be a unitary driveshaft which consists of a single driveshaft component.

In embodiments in which the drilling apparatus comprises a transmission section axially interposed between the drive section and the bearing section, the transmission section may be located at any axial position between the drive section and the bearing section, and may be connected directly or indirectly with the drive section and the bearing section.

In some embodiments, the transmission section may be connected directly with the drive section. In some embodiments, the transmission section may be connected directly with the bearing section. In some embodiments, the transmission section may be connected directly with both the drive section and the bearing section. In some particular embodiments, the distal drive housing end of the drive housing of the drive section may be connected directly with the proximal transmission housing end of the transmission housing so that the drive housing is connected directly with the transmission housing. In some particular embodiments, the distal transmission housing end of the transmission housing of the transmission section may be connected directly with the proximal bearing housing end of the bearing housing so that the transmission housing is connected directly with the bearing housing.

The drilling apparatus has a primary axis. The primary axis of the drilling apparatus is the axis of components or sections of the drilling apparatus which are located toward the proximal end of the drilling apparatus. In some embodiments, the primary axis of the drilling apparatus may be the axis of the drive section of the drilling apparatus.

The driveshaft has a driveshaft axis. The driveshaft axis is the axis of rotation of the driveshaft within the bearing housing.

In some embodiments, the driveshaft axis may be concentric with and/or parallel with the primary axis of the drilling apparatus. In such embodiments, the drilling apparatus may be described as a "straight" or performance drilling apparatus, and may be suitable for use in non-directional drilling.

In some embodiments, the driveshaft axis may be oblique to the primary axis of the drilling apparatus so that there is an angle between the driveshaft axis and the primary axis and so that the primary axis and the driveshaft axis intersect at an axis intersection point. In such embodiments, the drilling apparatus may be described as a "bent" drilling apparatus, and may be suitable for use in directional drilling.

The drilling apparatus may be configured in any suitable manner in order to provide that the driveshaft axis is oblique to the primary axis. In some embodiments, one or more sections of the drilling apparatus may be configured to provide that the driveshaft axis is oblique to the primary axis. In some embodiments, the drilling apparatus may comprise a bend section which is configured to provide that the driveshaft axis is oblique to the primary axis. In some embodiments, the transmission section may be configured to provide that the driveshaft axis is oblique to the primary axis.

In some embodiments, the axis intersection point between the primary axis and the driveshaft axis may be axially located between the proximal bearing housing end and the distal bearing housing end.

In some particular embodiments, the bearing section may be configured to provide that the driveshaft axis is oblique to the primary axis. In some such embodiments, the bearing housing may comprise an angular offset which causes the driveshaft axis to be oblique to the primary axis. The angular offset may comprise any feature or combination of features of the bearing housing which are capable of providing the angular offset.

As a first non-limiting example, the angular offset may comprise a bend in the bearing housing which causes all or a portion of the bearing housing to be oblique to the primary axis of the drilling apparatus. In such embodiments, the angular offset may be described as an "external bend" in the bearing housing.

As a second non-limiting example, the angular offset may comprise a bearing housing bore which is oblique to the primary axis of the drilling apparatus. In such embodiments, the angular offset may be described as an "internal bend" in the bearing housing.

The bearing assembly is radially interposed between the bearing housing and the driveshaft. The bearing assembly rotatably supports the driveshaft within the bearing housing bore.

The bearing assembly may comprise any number and/or any types of bearings. In some embodiments, the bearing assembly may comprise one or more thrust bearings for transmitting axial loads between the bearing housing and the driveshaft and/or one or more radial bearings for transmitting radial loads between the bearing housing and the driveshaft.

The one or more thrust bearings and/or one or more radial bearings may comprise any suitable type or types of bearing, including as non-limiting examples, plain bearings and rolling element bearings.

In some embodiments, the bearing assembly may comprise one or more bearings comprising a stationary bearing component and/or a rotating bearing component.

A stationary bearing component is connected or otherwise associated with the bearing housing such that the stationary bearing component is substantially stationary relative to the bearing housing. A stationary bearing component may be connected directly or indirectly with the bearing housing in any suitable manner. As non-limiting examples, a stationary bearing component may be threadably connected with the bearing housing, or may be connected with the bearing housing with fasteners, welds or an interference fit.

A rotating bearing component is connected or otherwise associated with the driveshaft such that the rotating bearing component is substantially stationary relative to the driveshaft and is rotatable relative to the bearing housing. A rotating bearing component may be connected directly or indirectly with the driveshaft in any suitable manner. As non-limiting examples, a rotating bearing component may be threadably connected with the driveshaft, or may be connected with the driveshaft with fasteners, welds or an interference fit.

In some embodiments, a stationary bearing component may be indirectly connected with the bearing housing by being non-rotatably engaged with a sleeve which in turn is non-rotatably engaged with the bearing housing.

In some embodiments, a plurality of stationary bearing components may be indirectly connected with the bearing housing by being non-rotatably engaged with a single sleeve which is non-rotatably engaged with the bearing housing. In some embodiments, a plurality of stationary bearing components may be indirectly connected with the bearing housing by being non-rotatably engaged with separate sleeves which are each non-rotatably engaged with the bearing housing.

A sleeve may be non-rotatably engaged with the bearing housing in any suitable manner. In some embodiments, a sleeve and the bearing housing may comprise complementary engagement surfaces. The complementary engagement surfaces may comprise any surfaces which are capable of providing a non-rotatable engagement between the sleeve and the bearing housing. As non-limiting examples, the complementary engagement surfaces may comprise interlocking splines, tabs and notches, lugs and grooves, etc.

A sleeve may be non-rotatably engaged with a stationary bearing component in any suitable manner. In some embodiments, a sleeve and a stationary bearing component may comprise complementary engagement surfaces. The complementary engagement surfaces may comprise any surfaces which are capable of providing a non-rotatable engagement between the sleeve and the stationary bearing component. As non-limiting examples, the complementary engagement surfaces may comprise interlocking splines, tabs and notches, lugs and grooves, etc.

In some embodiments, a rotating bearing component may be indirectly connected with the driveshaft by being non-rotatably engaged with a sleeve which in turn is non-rotatably engaged with the driveshaft.

In some embodiments, a plurality of rotating bearing components may be indirectly connected with the driveshaft by being non-rotatably engaged with a single sleeve which is non-rotatably engaged with the driveshaft. In some embodiments, a plurality of rotating bearing components may be indirectly connected with the driveshaft by being non-rotatably engaged with separate sleeves which are each non-rotatably engaged with the driveshaft.

A sleeve may be non-rotatably engaged with the driveshaft in any suitable manner. In some embodiments, a sleeve and the driveshaft may comprise complementary engagement surfaces. The complementary engagement surfaces may comprise any surfaces which are capable of providing a non-rotatable engagement between the sleeve and the driveshaft. As non-limiting examples, the complementary engagement surfaces may comprise interlocking splines, tabs and notches, lugs and grooves, etc.

A sleeve may be non-rotatably engaged with a rotating bearing component in any suitable manner. In some embodiments, a sleeve and a rotating bearing component may comprise complementary engagement surfaces. The complementary engagement surfaces may comprise any surfaces which are capable of providing a non-rotatable engagement between the sleeve and the rotating bearing component. As non-limiting examples, the complementary engagement surfaces may comprise interlocking splines, tabs and notches, lugs and grooves, etc.

In some embodiments, the bearing assembly may comprise a first bearing comprising a stationary first bearing component and/or a rotating first bearing component. In some embodiments, the bearing assembly may comprise a second bearing comprising a stationary second bearing component and/or a rotating second bearing component. In some embodiments, the bearing assembly may comprise a third bearing comprising a stationary third bearing component and/or a rotating third bearing component. In some embodiments, the bearing assembly may comprise a fourth bearing comprising a stationary fourth bearing component and/or a rotating fourth bearing component.

References in this document to a "first bearing", a "second bearing", a "third bearing", and/or a "fourth bearing" in association with bearings are intended to differentiate between the bearings, and do not indicate any particular order or sequence for the bearings. In addition, a reference in this document to a "first bearing" in association with a bearing does not require that there be a "second bearing", a "third bearing", and/or a "fourth bearing", a reference to a "second bearing" does not require that there be a "first bearing", a "third bearing", and/or a "fourth bearing", a reference to a "third bearing" does not require that there be a "first bearing", a "second bearing", and/or a "fourth bearing", and a reference to a "fourth bearing" does not require that there be a "first bearing", a "second bearing", and/or a "third bearing".

In some embodiments, the bearing assembly may comprise a first sleeve which is non-rotatably engaged with the bearing housing. In some embodiments, the bearing assembly may comprise a second sleeve which is non-rotatably engaged with the bearing housing. In some embodiments, the bearing assembly may comprise a third sleeve which is non-rotatably engaged with the bearing housing. In some embodiments, the bearing assembly may comprise a fourth sleeve which is non-rotatably engaged with the bearing housing.

References in this document to a "first sleeve", a "second sleeve", a "third sleeve", and/or a "fourth sleeve" in association with sleeves which are non-rotatably engaged with the bearing housing are intended to differentiate between the sleeves, and do not indicate any particular order or sequence for the sleeves. In addition, a reference in this document to a "first sleeve" in association with a sleeve which is non-rotatably engaged with the bearing housing does not require that there be a "second sleeve", a "third sleeve", and/or a "fourth sleeve", a reference to a "second sleeve" in association with a sleeve which is non-rotatably engaged with the bearing housing does not require that there be a "first sleeve", a "third sleeve", and/or a "fourth sleeve", a reference to a "third sleeve" in association with a sleeve which is non-rotatably engaged with the bearing housing does not require that there be a "first sleeve", a "second sleeve", and/or a "fourth sleeve", and a reference to a "fourth sleeve" in association with a sleeve which is non-rotatably engaged with the bearing housing does not require that there be a "first sleeve", a "second sleeve", and/or a "third sleeve".

In some embodiments, the bearing assembly may comprise a fifth sleeve which is non-rotatably engaged with the driveshaft. In some embodiments, the bearing assembly may comprise a sixth sleeve which is non-rotatably engaged with the driveshaft. In some embodiments, the bearing assembly may comprise a seventh sleeve which is non-rotatably engaged with the driveshaft. In some embodiments, the bearing assembly may comprise an eighth sleeve which is non-rotatably engaged with the driveshaft.

References in this document to a "fifth sleeve", a "sixth sleeve", a "seventh sleeve", and/or an "eighth sleeve" in association with sleeves which are non-rotatably engaged with the driveshaft are intended to differentiate between the sleeves, and do not indicate any particular order or sequence for the sleeves. In addition, a reference in this document to a "fifth sleeve" in association with a sleeve which is non-rotatably engaged with the driveshaft does not require that there be a "sixth sleeve", a "seventh sleeve", and/or an "eighth sleeve", a reference to a "sixth sleeve" in association with a sleeve which is non-rotatably engaged with the driveshaft does not require that there be a "fifth sleeve", a "seventh sleeve", and/or an "eighth sleeve", a reference to a "seventh sleeve" in association with a sleeve which is non-rotatably engaged with the driveshaft does not require that there be a "fifth sleeve", a "sixth sleeve", and/or an "eighth sleeve", and a reference to an "eighth sleeve" in association with a sleeve which is non-rotatably engaged with the driveshaft does not require that there be a "fifth sleeve", a "sixth sleeve", and/or a "seventh sleeve".

In some embodiments, one or more of a stationary first bearing component, a stationary second bearing component, a stationary third bearing component, and a stationary fourth bearing component may be non-rotatably engaged with one or more of a first sleeve, a second sleeve, a third sleeve, and a fourth sleeve, which in turn may be non-rotatably engaged with the bearing housing.

In some embodiments, one or more of a rotating first bearing component, a rotating second bearing component, a rotating third bearing component, and a rotating fourth bearing component may be non-rotatably engaged with one or more of a fifth sleeve, a sixth sleeve, a seventh sleeve, and an eighth sleeve, which in turn may be non-rotatably engaged with the driveshaft.

In some particular embodiments, a first sleeve may be non-rotatably engaged with the bearing housing and with a stationary first bearing component so that the stationary first bearing component is non-rotatable relative to the bearing housing. In some such embodiments, the first sleeve and the bearing housing may comprise complementary engagement surfaces for non-rotatably engaging the first sleeve with the bearing housing. In some such embodiments, the first sleeve and the stationary first bearing component may comprise complementary engagement surfaces for non-rotatably engaging the first sleeve with the stationary first bearing component.

In some particular embodiments, a second sleeve may be non-rotatably engaged with the bearing housing and with a stationary second bearing component so that the stationary second bearing component is non-rotatable relative to the bearing housing. In some such embodiments, the second sleeve and the bearing housing may comprise complementary engagement surfaces for non-rotatably engaging the second sleeve with the bearing housing. In some such embodiments, the second sleeve and the stationary second bearing component may comprise complementary engagement surfaces for non-rotatably engaging the second sleeve with the stationary second bearing component.

In some particular embodiments, a first sleeve may be non-rotatably engaged with the bearing housing and with a stationary third bearing component so that the stationary third bearing component is non-rotatable relative to the bearing housing. In some such embodiments, the first sleeve and the bearing housing may comprise complementary engagement surfaces for non-rotatably engaging the first sleeve with the bearing housing. In some such embodiments, the first sleeve and the stationary third bearing component may comprise complementary engagement surfaces for non-rotatably engaging the first sleeve with the stationary third bearing component.

In some particular embodiments, a third sleeve may be non-rotatably engaged with the bearing housing and with a stationary third bearing component so that the stationary third bearing component is non-rotatable relative to the bearing housing. In some such embodiments, the third sleeve and the bearing housing may comprise complementary engagement surfaces for non-rotatably engaging the third sleeve with the bearing housing. In some such embodiments, the third sleeve and the stationary third bearing component may comprise complementary engagement surfaces for non-rotatably engaging the third sleeve with the stationary third bearing component.

In some particular embodiments, a second sleeve may be non-rotatably engaged with the bearing housing and with a stationary fourth bearing component so that the stationary fourth bearing component is non-rotatable relative to the bearing housing. In some such embodiments, the second sleeve and the bearing housing may comprise complementary engagement surfaces for non-rotatably engaging the second sleeve with the bearing housing. In some such embodiments, the second sleeve and the stationary fourth bearing component may comprise complementary engagement surfaces for non-rotatably engaging the second sleeve with the stationary fourth bearing component.

In some particular embodiments, a fourth sleeve may be non-rotatably engaged with the bearing housing and with a stationary fourth bearing component so that the stationary fourth bearing component is non-rotatable relative to the bearing housing. In some such embodiments, the fourth sleeve and the bearing housing may comprise complementary engagement surfaces for non-rotatably engaging the fourth sleeve with the bearing housing. In some such embodiments, the fourth sleeve and the stationary fourth bearing component may comprise complementary engagement surfaces for non-rotatably engaging the fourth sleeve with the stationary fourth bearing component.

In some particular embodiments, a fifth sleeve may be non-rotatably engaged with the bearing housing and with a rotating first bearing component so that the rotating first bearing component is non-rotatable relative to the bearing housing. In some such embodiments, the fifth sleeve and the bearing housing may comprise complementary engagement surfaces for non-rotatably engaging the fifth sleeve with the bearing housing. In some such embodiments, the fifth sleeve and the rotating first bearing component may comprise complementary engagement surfaces for non-rotatably engaging the fifth sleeve with the rotating first bearing component.

In some particular embodiments, a sixth sleeve may be non-rotatably engaged with the bearing housing and with a rotating second bearing component so that the rotating second bearing component is non-rotatable relative to the bearing housing. In some such embodiments, the sixth sleeve and the bearing housing may comprise complementary engagement surfaces for non-rotatably engaging the sixth sleeve with the bearing housing. In some such embodiments, the sixth sleeve and the rotating second bearing component may comprise complementary engagement surfaces for non-rotatably engaging the sixth sleeve with the rotating second bearing component.

In some particular embodiments, a fifth sleeve may be non-rotatably engaged with the bearing housing and with a rotating third bearing component so that the rotating third bearing component is non-rotatable relative to the bearing housing. In some such embodiments, the fifth sleeve and the bearing housing may comprise complementary engagement surfaces for non-rotatably engaging the fifth sleeve with the bearing housing. In some such embodiments, the fifth sleeve and the rotating third bearing component may comprise complementary engagement surfaces for non-rotatably engaging the fifth sleeve with the rotating third bearing component.

In some particular embodiments, a seventh sleeve may be non-rotatably engaged with the bearing housing and with a rotating third bearing component so that the rotating third bearing component is non-rotatable relative to the bearing housing. In some such embodiments, the seventh sleeve and the bearing housing may comprise complementary engagement surfaces for non-rotatably engaging the seventh sleeve with the bearing housing. In some such embodiments, the seventh sleeve and the rotating third bearing component may comprise complementary engagement surfaces for non-rotatably engaging the seventh sleeve with the rotating third bearing component.

In some particular embodiments, a sixth sleeve may be non-rotatably engaged with the bearing housing and with a rotating fourth bearing component so that the rotating fourth bearing component is non-rotatable relative to the bearing housing. In some such embodiments, the sixth sleeve and the bearing housing may comprise complementary engagement surfaces for non-rotatably engaging the sixth sleeve with the bearing housing. In some such embodiments, the sixth sleeve and the rotating fourth bearing component may comprise complementary engagement surfaces for non-rotatably engaging the sixth sleeve with the rotating fourth bearing component.

In some particular embodiments, an eighth sleeve may be non-rotatably engaged with the bearing housing and with a rotating fourth bearing component so that the rotating fourth bearing component is non-rotatable relative to the bearing housing. In some such embodiments, the eighth sleeve and the bearing housing may comprise complementary engagement surfaces for non-rotatably engaging the eighth sleeve with the bearing housing. In some such embodiments, the eighth sleeve and the rotating fourth bearing component may comprise complementary engagement surfaces for non-rotatably engaging the eighth sleeve with the rotating fourth bearing component.

In some embodiments, the first bearing may be a thrust bearing. In some embodiments, the first bearing may be a radial bearing. In some embodiments, the second bearing may be a thrust bearing. In some embodiments, the second bearing may be a radial bearing. In some embodiments, the third bearing may be a thrust bearing. In some embodiments, the third bearing may be a radial bearing. In some embodiments, the fourth bearing may be a thrust bearing. In some embodiments, the fourth bearing may be a radial bearing.

In some particular embodiments, the first bearing may be a thrust bearing and the second bearing may be a thrust bearing.

In some particular embodiments, the third bearing may be a radial bearing and the fourth bearing may be a radial bearing.

In some particular embodiments, one of the first bearing and the second bearing may be a thrust bearing and the other of the first bearing and the second bearing may be a radial bearing.

In some particular embodiments, one of the third bearing and the fourth bearing may be a thrust bearing and the other of the third bearing and the fourth bearing may be a radial bearing.

In some particular embodiments, one of the first bearing and the third bearing may be a thrust bearing and the other of the first bearing and the third bearing may be a radial bearing.

In some particular embodiments, one of the second bearing and the fourth bearing may be a thrust bearing and the other of the second bearing and the fourth bearing may be a radial bearing.

FIGS. 1-13 depict non-limiting embodiments of a drilling apparatus, wherein the drilling apparatus comprises a drive section and a bearing section.

Figure 2:
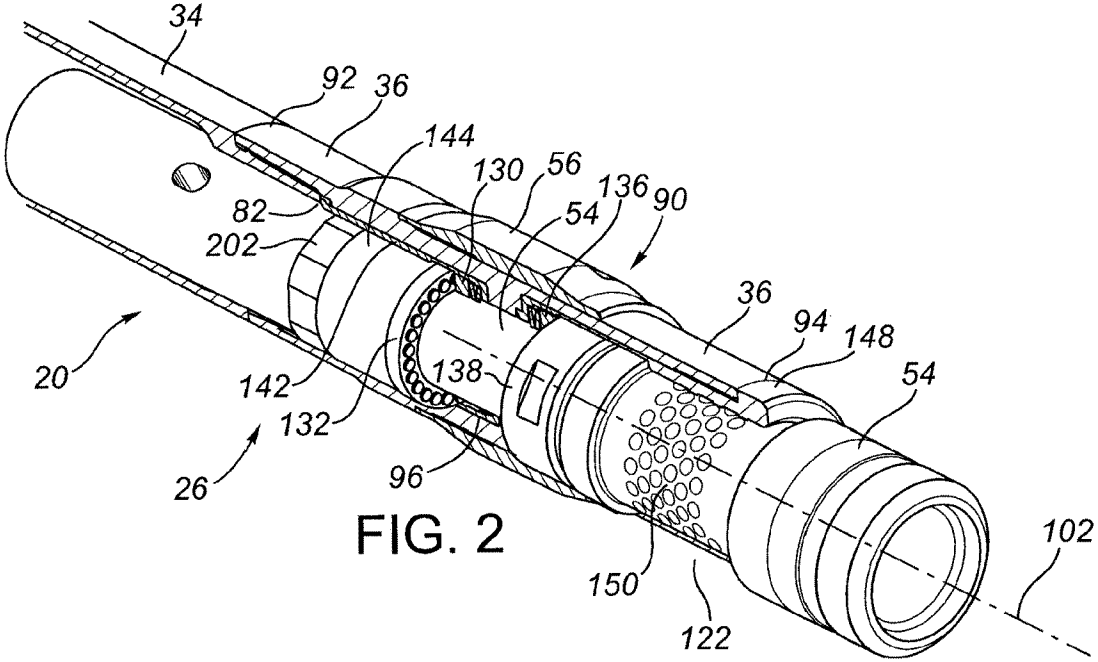
FIG. 2 is a partial cutaway pictorial view of a bearing section in an exemplary embodiment of a drilling apparatus.
Figure 3:
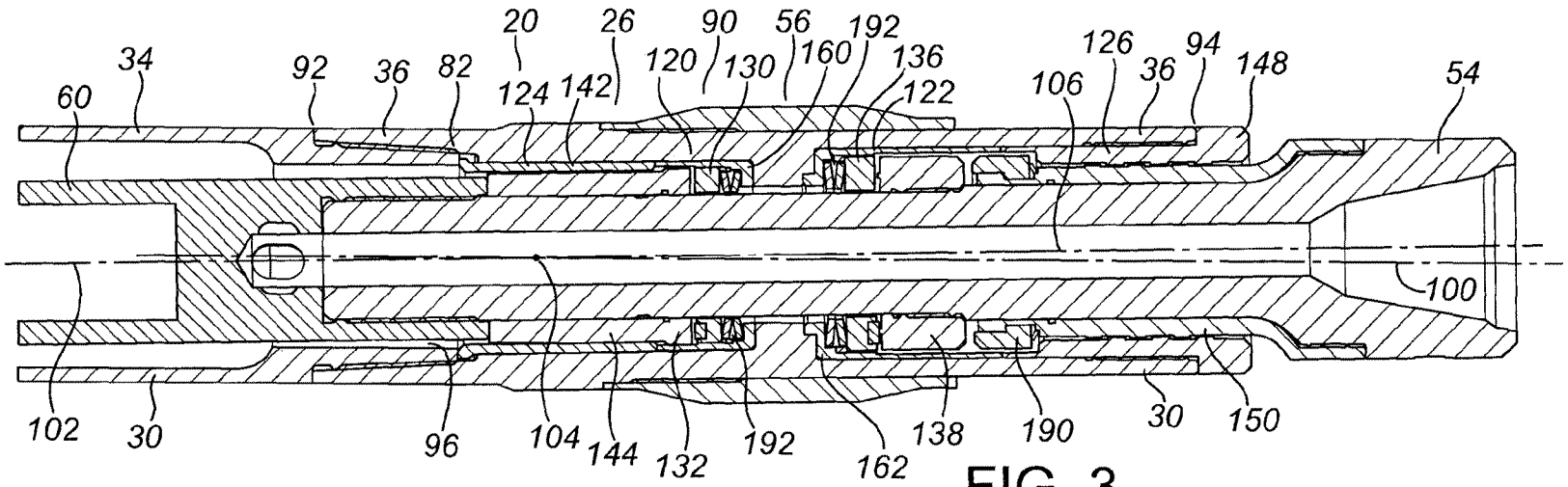
FIG. 3 is a longitudinal section assembly view of the bearing section depicted in FIG. 2.
Figure 4:
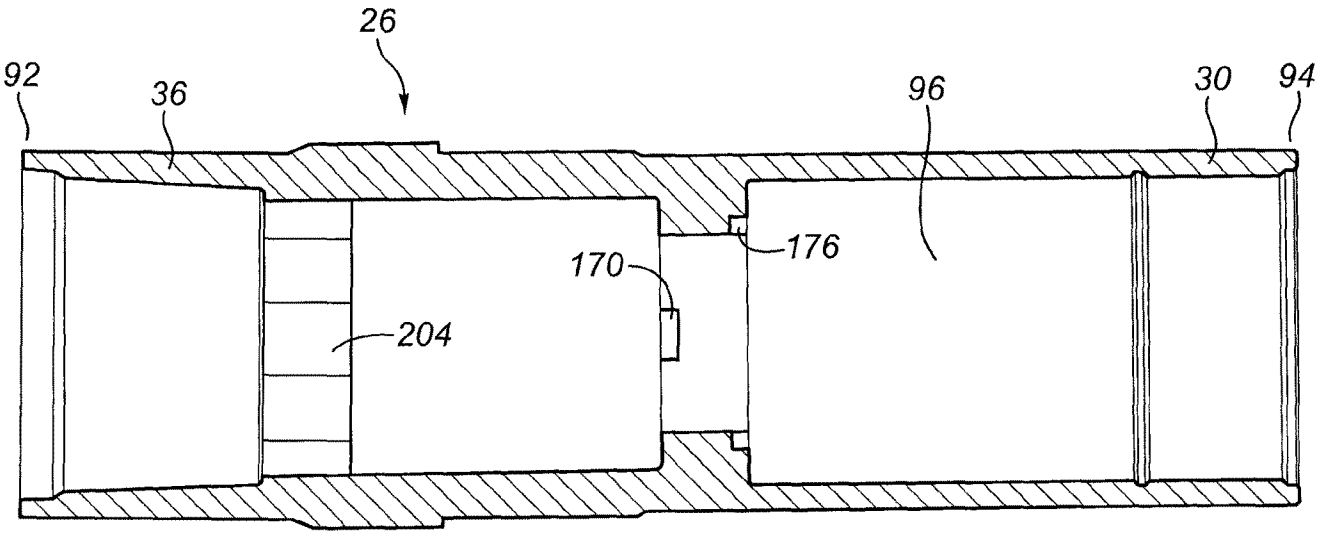
FIG. 4 is a longitudinal section view of the bearing housing in the bearing section depicted in FIG. 2.
Figure 5:
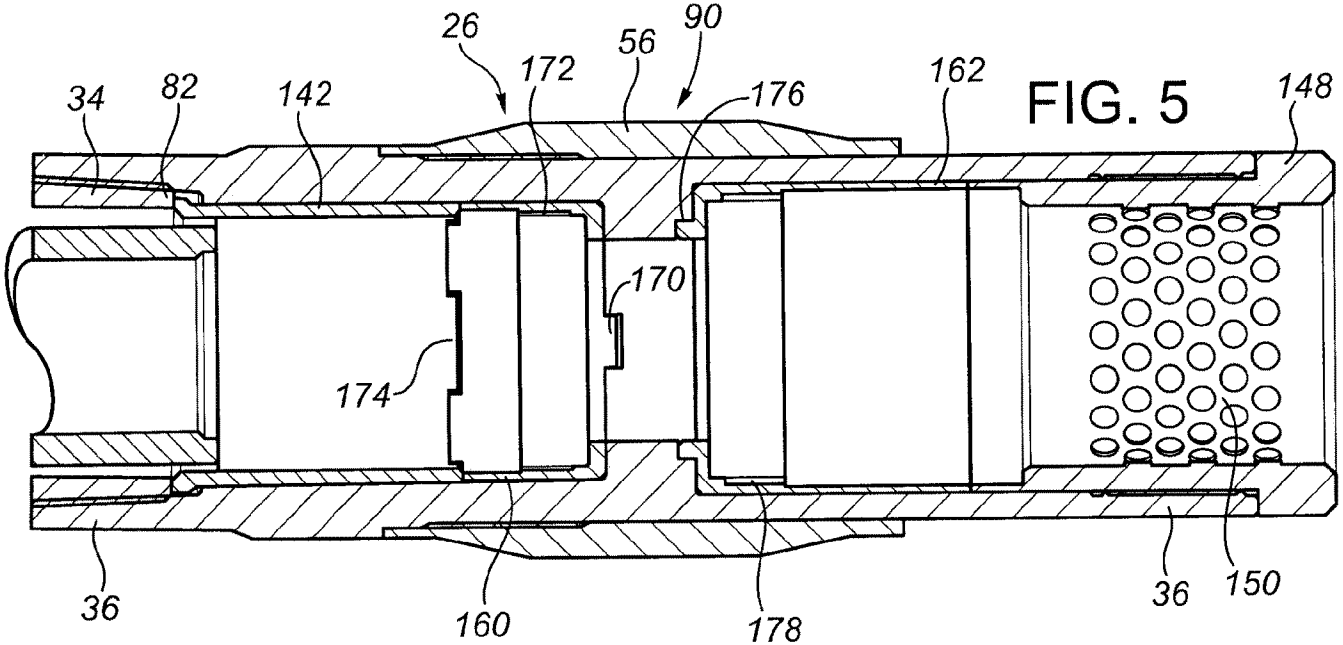
FIG. 5 is a cutaway view of assembled components of the bearing section depicted in FIG. 2.
Figure 11:
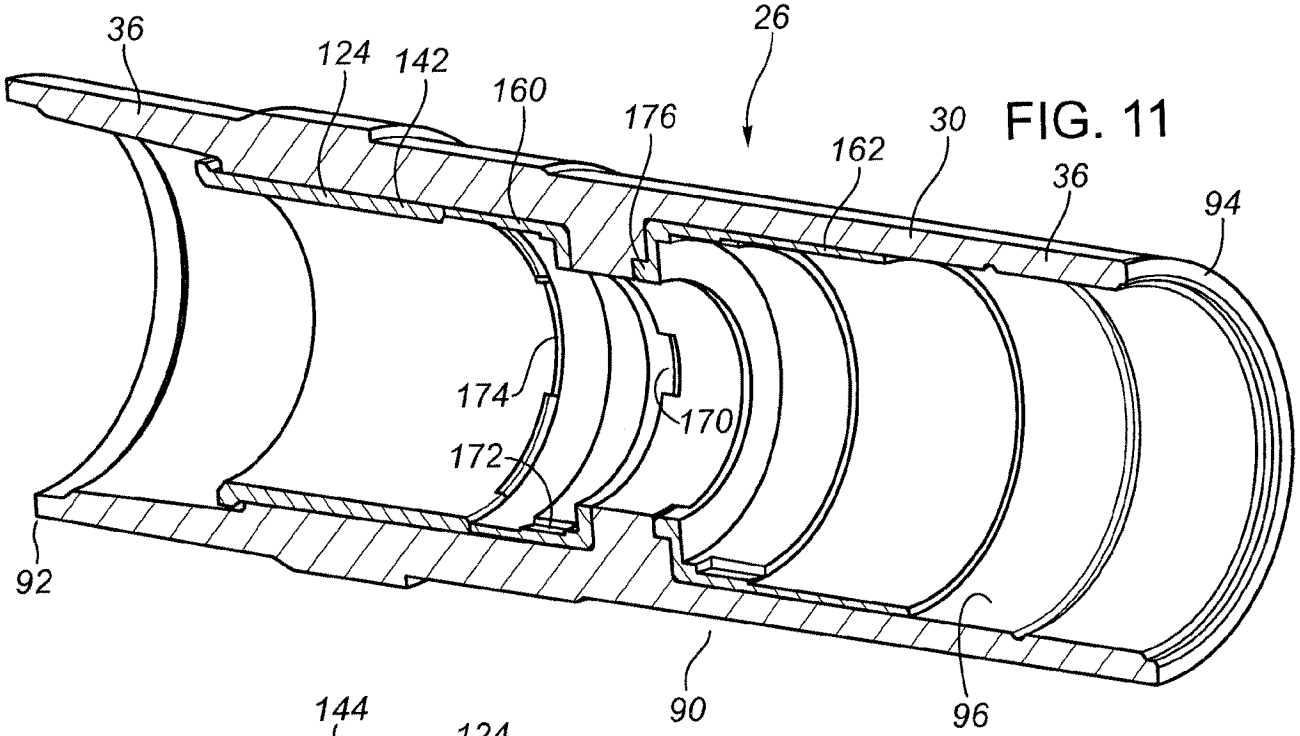
FIG. 11 is a pictorial longitudinal section assembly view of selected assembled components of the bearing section depicted in FIG. 2.
Figure 12:
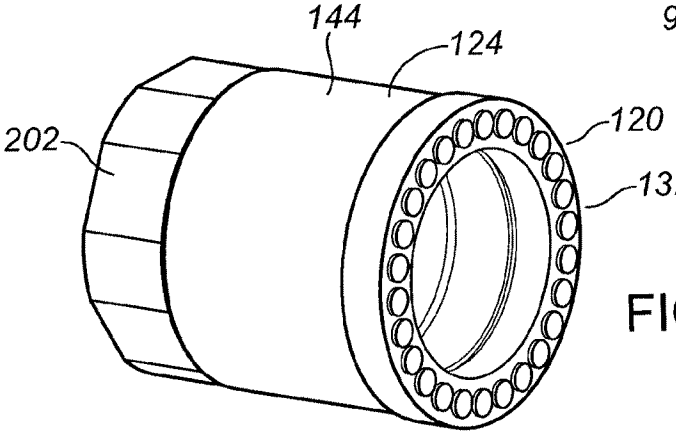
FIG. 12 is a pictorial view of a unitary bearing component comprising a rotating radial bearing component and a rotating thrust bearing component in the bearing section depicted in FIG. 2.

More particularly, FIG. 1 depicts a drilling apparatus, including a drive section, a transmission section, and a bearing section. FIG. 2 and FIG. 3 depict the bearing section in an exemplary embodiment of a drilling apparatus of the type depicted in FIG. 1. FIG. 4 depicts a bearing housing in the bearing section of the exemplary embodiment of the drilling apparatus. FIG. 5 depicts assembled components of the bearing section in the exemplary embodiment of the drilling apparatus. FIGS. 6-10 depict individual components of the bearing section in the exemplary embodiment of the drilling apparatus. FIG. 11-12 depict selected assembled components of the bearing section in the exemplary embodiment of the drilling apparatus. FIG. 13 depicts an exemplary sequence for assembling the bearing section in the exemplary embodiment of the drilling apparatus.

FIGS. 1-13 are exemplary only. The features of the drilling apparatus depicted in FIGS. 1-13 and described herein may be included in alternate designs and types of drilling apparatus.

Referring to FIGS. 1-13, the drilling apparatus (20) described herein comprise a drilling motor. Referring to FIG. 1, the drilling motor comprises a plurality of sections as depicted in FIG. 1. The drilling motor may comprise additional sections which are not depicted in FIG. 1.

Referring to FIG. 1, the drilling motor comprises a drive section or power section (22) and a bearing section (26). The bearing section (26) is axially distal to the power section (22). One or more sections of the drilling motor may be axially interposed between the power section (22) and the bearing section (26). As depicted in FIG. 1, the drilling motor further comprises a transmission section (24) which is axially interposed between the power section (22) and the bearing section (26). These sections of the drilling motor constitute components of a powertrain which utilizes fluid energy to rotate a drill bit (28).

The sections of the drilling motor are contained within a tubular housing (30).

As depicted in FIG. 1, the housing (30) comprises a plurality of housing sections connected together with threaded connections, including a tubular power housing (32) for the power section (22), a tubular transmission housing (34) for the transmission section (24), and a tubular bearing housing (36) for the bearing section (26).

The power housing (32) may comprise a plurality of power housing components which together provide the power housing (32), or the power housing (32) may be a unitary power housing (32) which is formed from a single drive housing component.

The transmission housing (34) may comprise a plurality of transmission housing components which together provide the transmission housing (34), or the transmission housing (34) may be a unitary transmission housing (34) which is formed from a single transmission housing component.

The bearing housing (36) may comprise a plurality of bearing housing components which together provide the bearing housing (36), or the bearing housing (36) may be a unitary bearing housing (36) which is formed from a single bearing housing component.

The power section (22) of the drilling motor comprises a stator (50) and a drive member or rotor (52). The stator (50) is fixedly connected with the power housing (32), and the rotor (52) is rotatable within the stator (50) in response to fluid circulating through the power section (22).

As depicted in FIG. 1, the power section (22) is a Moineau-type power section in which the stator (50) and the rotor (52) are lobed. The rotor (52) has one fewer lobe than the stator (50), and rotates eccentrically within the stator (50).

The transmission section (24) accommodates and converts the eccentric movement of the rotor (52) to concentric rotation of a driveshaft (54) within the bearing section (26). The transmission section (24) also transmits rotational drive energy from the power section (22) to the bearing section (26).

As depicted in FIG. 1, the transmission section (24) comprises the transmission housing (34) and a transmission member or transmission shaft (60) which is connected between the rotor (52) and the driveshaft (54) so that rotation of the rotor (52) causes rotation of the transmission shaft (60), and rotation of the transmission shaft (60) causes rotation of the driveshaft (54).

As depicted in FIG. 1, the bearing section (26) comprises the bearing housing (36), the driveshaft (44) and a bearing assembly (not shown in FIG. 1) which rotatably supports the driveshaft (54) within the bearing housing bore (42). As depicted in FIG. 1, the bearing section (26) also comprises a stabilizer (56) which is threadably connected with the exterior of the bearing housing (36).

As depicted in FIG. 1, the drill bit (28) is connected with the driveshaft (54) so that rotation of the driveshaft (54) causes rotation of the drill bit (28).

Referring now to all of FIGS. 1-13, features of an exemplary embodiment of the drilling apparatus (20) are described in further detail.

Referring to FIG. 1, the exemplary embodiment of the drilling apparatus (20) comprises the drive section or power section (22), the transmission section (24), and the bearing section (26).

Referring to FIG. 1, in the exemplary embodiment, the power section (22) comprises the drive or power housing (32), the stator (50), and the drive member or rotor (52). The power housing (32) has a proximal power housing end (70) and a distal power housing end (72).

Referring to FIG. 1, in the exemplary embodiment, the transmission section (24) comprises the transmission housing (34) and the transmission member or transmission shaft (60). The transmission housing (34) has a proximal transmission housing end (80) and a distal transmission housing end (82).

Referring to FIGS. 2-3, in the exemplary embodiment, the bearing section (26) comprises the bearing housing (36), the driveshaft (54), and a bearing assembly (90).

The bearing housing (36) has a proximal bearing housing end (92), a distal bearing housing end (94), and defines a bearing housing bore (96). In the exemplary embodiment, the bearing housing (36) is a unitary bearing housing (36) which is formed from a single bearing housing component.

The driveshaft (54) is received within the bearing housing bore (96) and is rotatable relative to the bearing housing (36).

The bearing assembly (90) is radially interposed between the bearing housing (36) and the driveshaft (54) and rotatably supports the driveshaft (54) within the bearing housing bore (96).

In the exemplary embodiment, the transmission section (24) is the only section of the drilling apparatus (20) which is axially interposed between the power section (22) and the bearing section (26). More particularly, the transmission housing (34) is connected directly with both the power housing (32) and the bearing housing (36). As a result, in the exemplary embodiment, the distal power housing end (72) is connected directly with the proximal transmission housing end (80), and the distal transmission housing end (82) is connected directly with the proximal bearing housing end (92). In the exemplary embodiment, the transmission shaft (60) is connected between the rotor (52) and the driveshaft (54).

Referring to FIG. 1 and FIG. 3, the drilling apparatus (20) has a primary axis (100). In the exemplary embodiment, the primary axis (100) is the axis of the power section (22) and the transmission section (24) of the drilling apparatus.

Referring to FIG. 1 and FIG. 3, the driveshaft (54) has a driveshaft axis (102). The driveshaft axis (102) is the axis of rotation of the driveshaft (54) within the bearing housing (36).

In the exemplary embodiment, the driveshaft axis (102) is oblique to the primary axis (100). The primary axis (100) and the driveshaft axis (102) intersect at an axis intersection point (104). In the exemplary embodiment, the axis intersection point (104) is axially located between the proximal bearing housing end (92) and the distal bearing housing end (94).

In the exemplary embodiment, the bearing housing (36) comprises an angular offset (106) which causes the driveshaft axis (102) to be oblique to the primary axis (100). In the exemplary embodiment, the angular offset (106) may comprise a bend in the bearing housing (36), thereby resulting in an "external bend" in the bearing housing. Alternatively, in the exemplary embodiment, the angular offset may comprise a slant or tilt of the bearing housing bore (96) within the bearing housing (36), thereby resulting in an "internal bend" in the bearing housing (36).

As a result, in the exemplary embodiment, the drilling apparatus (20) is a "bent" drilling apparatus (20) which may be suitable for use in directional drilling.

Referring to FIGS. 2-3 and 5-12, components of the bearing assembly (90) in the bearing section (26) of the exemplary embodiment of the drilling apparatus (20) are depicted.

In the exemplary embodiment, the bearing assembly (90) comprises a first bearing (120), a second bearing (122), a third bearing (124) and a fourth bearing (126).

In the exemplary embodiment, the first bearing (120) is a thrust bearing which is adapted to transmit "off-bottom" (i.e. tensile) axial loads between the bearing housing (36) and the driveshaft (54). The first bearing (120) comprises a stationary first bearing component (130) which is non-rotatably engaged with the bearing housing (36) and a rotating first bearing component (132) which is non-rotatably engaged with the driveshaft (54). In the exemplary embodiment, the first bearing (120) is a plain bearing in which the bearing surfaces between the first bearing components (130, 132) may comprise wear resistant inserts such as polycrystalline diamond inserts.

In the exemplary embodiment, the second bearing (122) is a thrust bearing which is adapted to transmit "on-bottom" (i.e., compressive) axial loads between the bearing housing (36) and the driveshaft (54). The second bearing (122) comprises a stationary second bearing component (136) which is non-rotatably engaged with the bearing housing (36) and a rotating second bearing component (138) which is non-rotatably engaged with the driveshaft (54). In the exemplary embodiment, the second bearing (122) is a plain bearing in which the bearing surfaces between the second bearing components (136, 138) may comprise wear resistant inserts such as polycrystalline diamond inserts.

In the exemplary embodiment, the third bearing (124) is a proximal radial bearing which is adapted to transmit transverse loads between the bearing housing (36) and the driveshaft (54). The third bearing (124) comprises a stationary third bearing component (142) which is non-rotatably engaged with the bearing housing (36) and a rotating third bearing component (144) which is non-rotatably engaged with the driveshaft (54). In the exemplary embodiment, the third bearing (124) is a plain bearing in which the bearing surfaces between the third bearing components (142, 144) may comprise wear resistant inserts such as polycrystalline diamond inserts.

In the exemplary embodiment, the fourth bearing (126) is a distal radial bearing which is adapted to transmit transverse loads between the bearing housing (36) and the driveshaft (54). The fourth bearing (126) comprises a stationary fourth bearing component (148) which is non-rotatably engaged with the bearing housing (36) and a rotating fourth bearing component (150) which is non-rotatably engaged with the driveshaft (54). In the exemplary embodiment, the fourth bearing (126) is a plain bearing in which the bearing surfaces between the fourth bearing components (148, 150) may comprise wear resistant inserts such as polycrystalline diamond inserts.

In the exemplary embodiment, the bearing assembly (90) further comprises a first sleeve (160) and a second sleeve (162), which are adapted to fit within the bearing housing bore (96). The first sleeve (160) and the second sleeve (162) are non-rotatably engaged with the bearing housing (36).

Figure 6B:
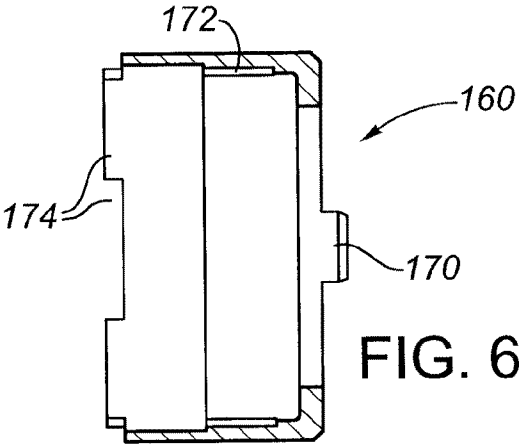
FIGS. 6A and 6B are a pictorial view and a longitudinal section view respectively of a first sleeve in the bearing section depicted in FIG. 2.
Figure 6A:
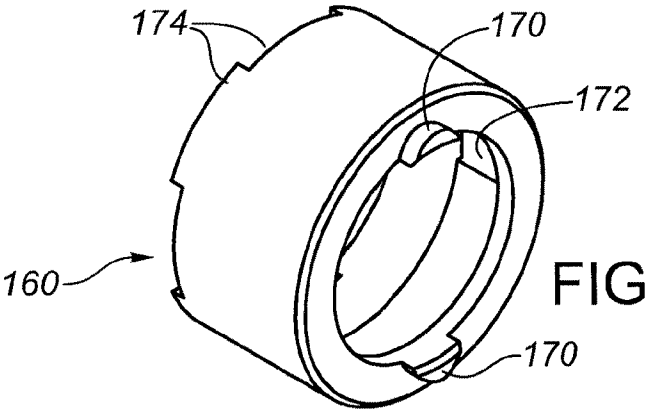

Referring to FIG. 4, FIG. 6 and FIG. 11, in the exemplary embodiment, the first sleeve (160) is non-rotatably engaged with the bearing housing (36) via complementary engagement surfaces (170). In the exemplary embodiment, the complementary engagement surfaces (170) comprise interlocking tabs and recesses on the first sleeve (160) and the bearing housing (36) respectively.

Figure 8:
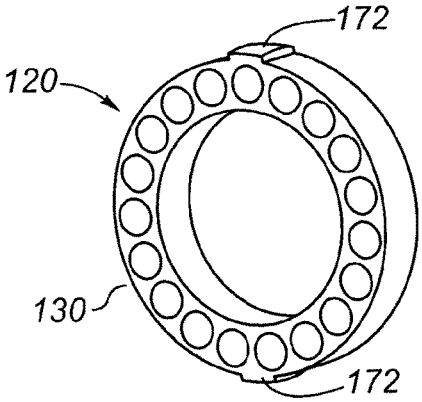
FIG. 8 is a pictorial view of a stationary first bearing component in the bearing section depicted in FIG. 2.

Referring to FIG. 5, FIG. 6 and FIG. 8, in the exemplary embodiment, the stationary first bearing component (130) is non-rotatably engaged with the first sleeve (160) via complementary engagement surfaces (172). As a result, the stationary first bearing component (130) is non-rotatably engaged with the bearing housing (36). In the exemplary embodiment, the complementary engagement surfaces (172) comprise interlocking protrusions and recesses on the stationary first bearing component (130) and the first sleeve (160) respectively.

Figure 10A:
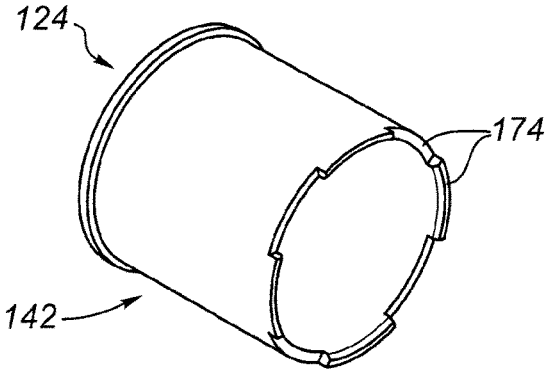
FIGS. 10A and 10B are a pictorial view and a longitudinal section view respectively of a stationary third bearing component in the bearing section depicted in FIG. 2.
Figure 10B:
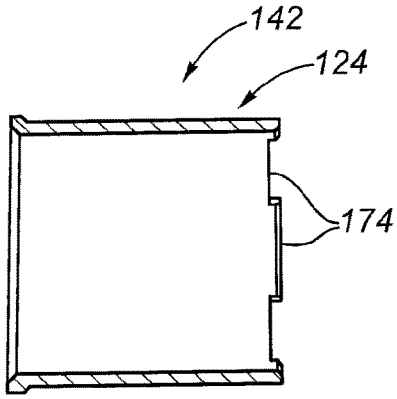

Referring to FIG. 5, FIG. 6 and FIG. 10, in the exemplary embodiment, the stationary third bearing component (142) is non-rotatably engaged with the first sleeve (160) via complementary engagement surfaces (174). As a result, the stationary third bearing component (142) is non-rotatably engaged with the bearing housing (36). In the exemplary embodiment, the complementary engagement surfaces (174) comprise interlocking tongues and slots on the stationary third bearing component (142) and the first sleeve (160) respectively.

Figure 7A:
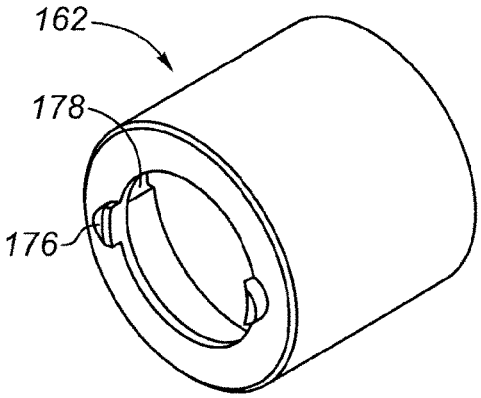
FIGS. 7A and 7B are a pictorial view and a longitudinal section view respectively of a second sleeve in the bearing section depicted in FIG. 2.
Figure 7B:
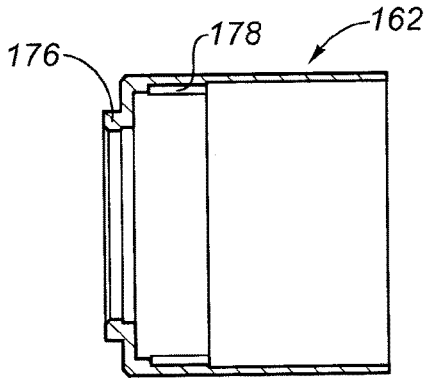

Referring to FIG. 4, FIG. 7 and FIG. 11, in the exemplary embodiment, the second sleeve (162) is non-rotatably engaged with the bearing housing (36) via complementary engagement surfaces (176). In the exemplary embodiment, the complementary engagement surfaces (176) comprise interlocking tabs and recesses on the second sleeve (162) and the bearing housing (36) respectively.

Figure 9:
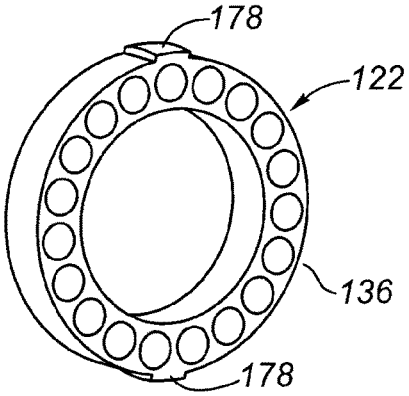
FIG. 9 is a pictorial view of a stationary second bearing component in the bearing section depicted in FIG. 2.

Referring to FIG. 5, FIG. 7 and FIG. 9, in the exemplary embodiment, the stationary second bearing component (136) is non-rotatably engaged with the second sleeve (162) via complementary engagement surfaces (178). As a result, the stationary second bearing component (136) is non-rotatably engaged with the bearing housing (36). In the exemplary embodiment, the complementary engagement surfaces (178) comprise interlocking protrusions and recesses on the stationary second bearing component (136) and the second sleeve (162) respectively.

Referring to FIG. 12, in the exemplary embodiment, the rotating first bearing component (132) and the rotating third bearing component (144) are connected together as a unitary bearing component (132, 144). Referring to FIG. 2, FIG. 3 and FIG. 5, the rotating first bearing component (132) and the rotating third bearing component (144) are non-rotatably engaged with the driveshaft (54) with a threaded connection.

Referring to FIG. 2 and FIG. 3, in the exemplary embodiment, the rotating second bearing component (138) is non-rotatably engaged with the driveshaft (54) with a threaded connection.

Referring to FIG. 2, FIG. 3 and FIG. 5, in the exemplary embodiment, the stationary fourth bearing component (148) is non-rotatably engaged with the bearing housing (36) with a threaded connection, and the rotating fourth bearing component (150) is non-rotatably engaged with the driveshaft (54) with a threaded connection or with an interference fit.

In the exemplary embodiment, a driveshaft catcher (190) is associated with the fourth bearing (126). The driveshaft catcher (190) helps to retain the driveshaft (54) within the bearing housing (36) in the event that the driveshaft (54) becomes disconnected from the transmission shaft (60) and/or the rotor (52).

Figure 13A:
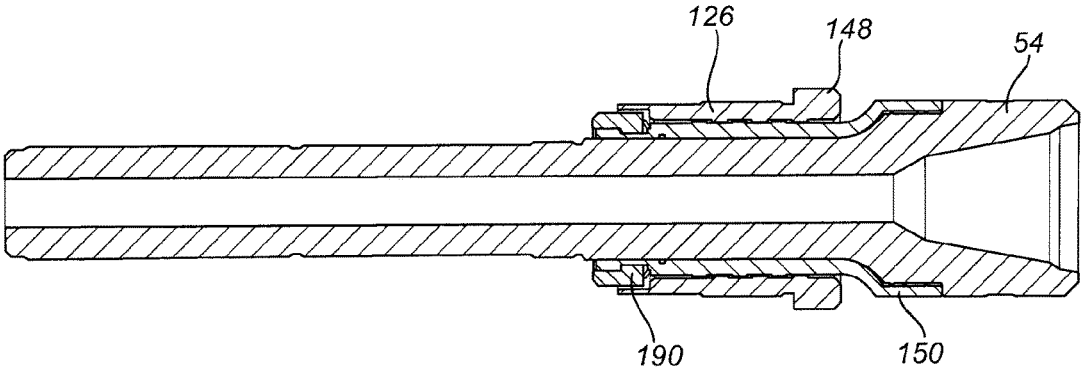
FIGS. 13A-13G depict an exemplary sequence for assembling the bearing section depicted in FIG. 2.
Figure 13B:
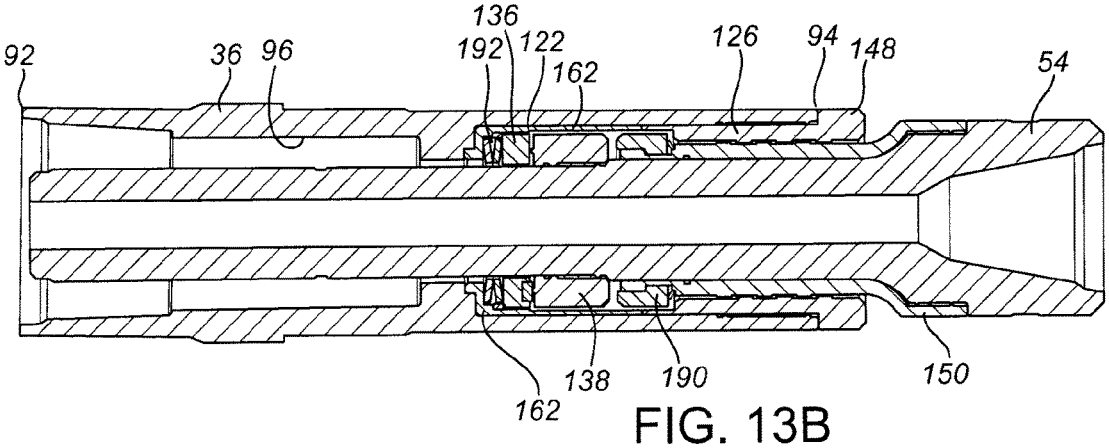
Figure 13C:
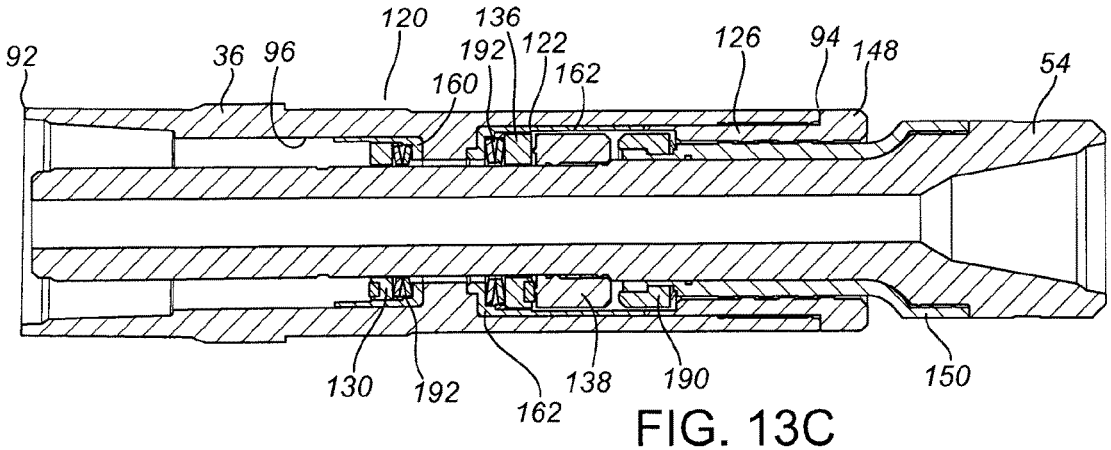
Figure 13D:
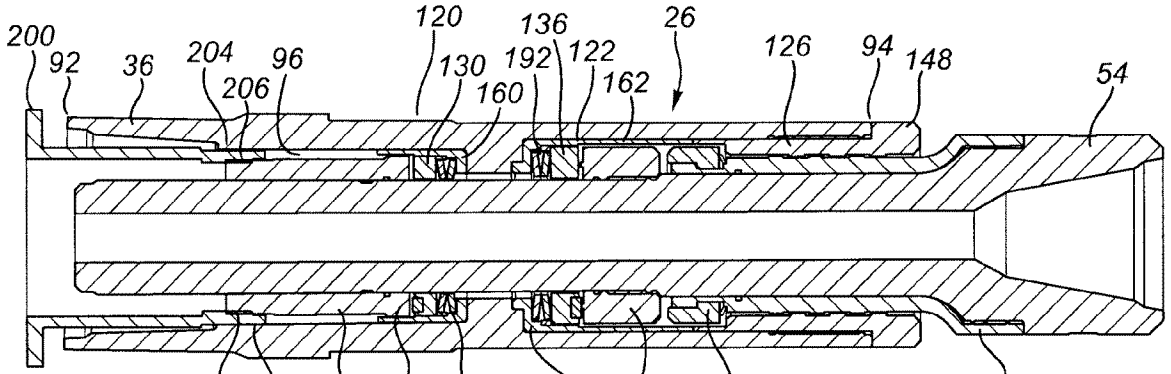
Figure 13E:
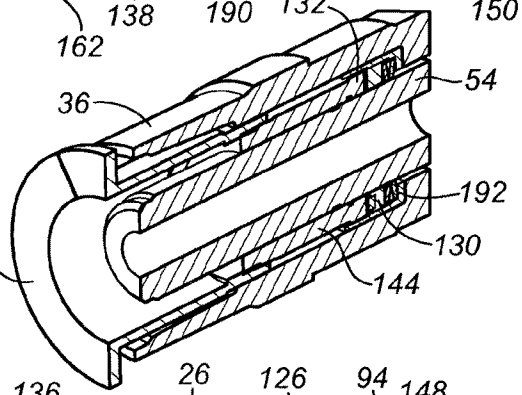

Referring to FIGS. 13A-13G, the bearing section (26) in the exemplary embodiment of the drilling apparatus (20) may be assembled in the following manner:

1. as depicted in FIG. 13A, the fourth bearing (126) and the driveshaft catcher (190) may be assembled onto the driveshaft (54);
2. as depicted in FIG. 13B, the rotating second bearing component (138) may be assembled onto the driveshaft (54), the second sleeve (162), a stack of preloading springs (192), and the stationary second bearing component (136) may be assembled within the bearing housing (36), and the bearing housing (36) may be assembled onto and connected with the stationary fourth bearing component (148);
3. as depicted in FIG. 13C, the first sleeve (160), a stack of preloading springs (192), and the stationary first bearing component (130) may be assembled within the bearing housing (36);
4. as depicted in FIG. 13D and FIG. 13E, the unitary bearing component (132, 144) comprising the rotating first bearing component (132) and the rotating third bearing component (144) may be assembled onto the driveshaft (54) using an assembly tool (200).

Figure 13F:
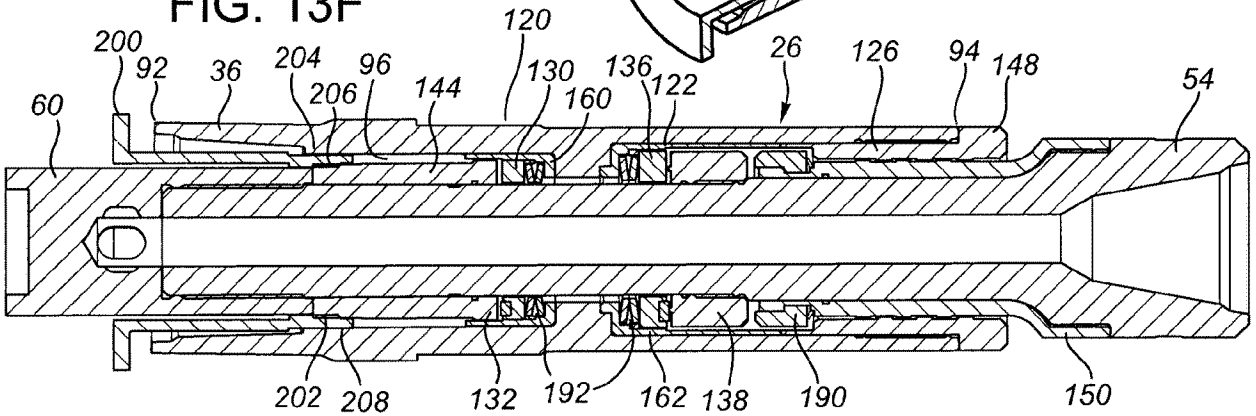
Figure 13G:
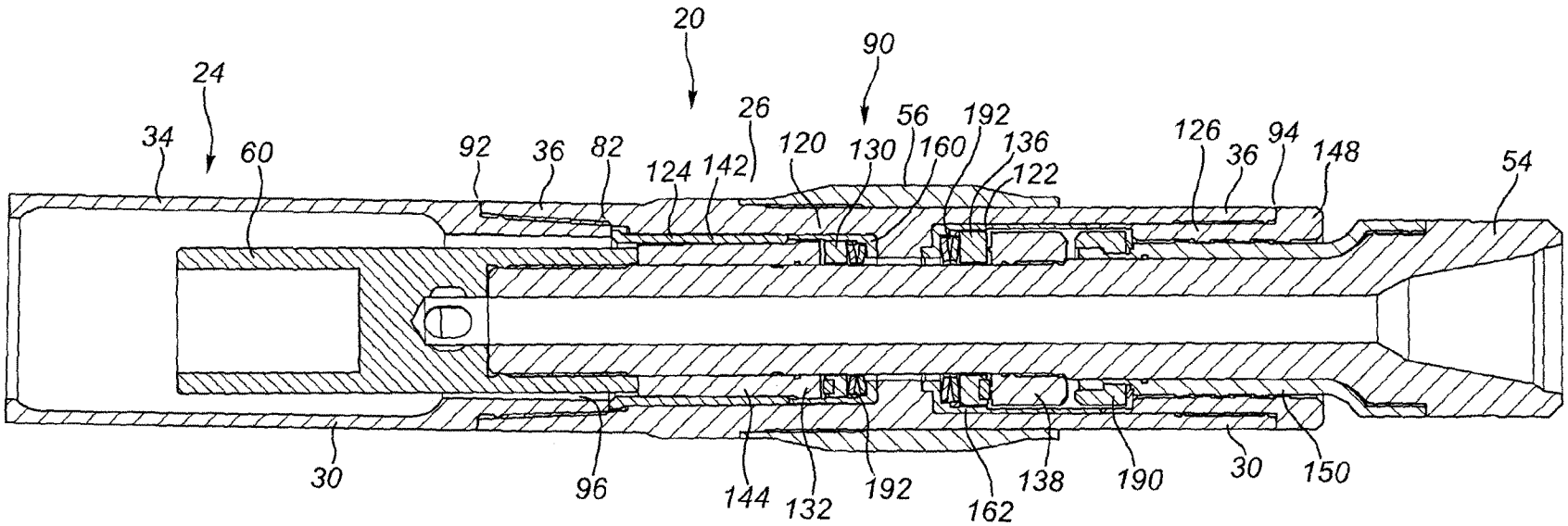

The distal end of the assembly tool (200) is configured to fit within the annular space between the unitary bearing component (132, 144) and the bearing housing (36). Referring to FIG. 12, the proximal end of the unitary bearing component (132, 144) comprises a polygonal exterior surface (202). Referring to FIG. 4, the portion of the bearing housing bore (96) which is adjacent to the proximal end of the unitary bearing component (132, 144) comprises a polygonal interior surface (204). The distal end of the assembly tool (200) comprises a polygonal interior surface (206) and a polygonal exterior surface (208) which are complementary to the polygonal surfaces (202, 204) respectively. As a result, inserting the distal end of the assembly tool (200) within the annular space will temporarily non-rotatably engage the unitary bearing component (132, 144) with the bearing housing (136). The unitary bearing component (132, 144) may then be assembled onto the driveshaft (54) by rotating the driveshaft (54) to make up the threaded connection between the unitary bearing component (132, 144) and the driveshaft (54);
5. as depicted in FIG. 13F, the transmission shaft (60) may be connected with the driveshaft (54) using the assembly tool (200). Since the unitary bearing component (132, 144) is non-rotatably engaged with the driveshaft (54), insertion of the assembly tool (200) into the annular space between the unitary bearing component (132, 144) and the bearing housing (36) will temporarily non-rotatably engage the driveshaft (54) with the bearing housing (36). The transmission shaft (60) may then be connected with the driveshaft (54) by rotating the transmission shaft (60), while the assembly tool (200) guides the transmission shaft (60) and restrains the driveshaft (54) against rotation;
6. as depicted in FIG. 13G, assembly of the bearing section (26) may be completed by assembling the stabilizer (56) onto the bearing housing (36), by assembling the stationary third bearing component (142) within the bearing housing (36), and by connecting the proximal bearing housing end (92) with the distal transmission housing end (82) so that the stationary third bearing component (142) is retained in engagement with the first sleeve (160) by the transmission housing (34); and
7. the remaining components of the drilling apparatus (20) which are proximal to the bearing section (26) and the transmission housing (34) may be assembled to complete the drilling apparatus (20).

Additional Disclosures

The following are non-limiting, specific embodiments of the drilling apparatus described herein:

Embodiment A

A drilling apparatus comprising a drive section and a bearing section axially distal to the drive section, wherein the bearing section comprises:

(a) a unitary bearing housing having a proximal bearing housing end, a distal bearing housing end, and defining a bearing housing bore;

(b) a driveshaft received within the bearing housing bore, wherein the driveshaft is rotatable relative to the bearing housing; and (c) a bearing assembly radially interposed between the bearing housing and the driveshaft, for rotatably supporting the driveshaft within the bearing housing bore.

Embodiment B

The drilling apparatus of Embodiment A wherein the drilling apparatus comprises a transmission section axially interposed between the drive section and the bearing section, wherein the transmission section comprises a transmission housing, wherein the transmission housing has a distal transmission housing end, and wherein the distal transmission housing end is connected directly with the proximal bearing housing end so that the transmission housing is connected directly with the bearing housing.

Embodiment C

The drilling apparatus of any one of Embodiments A or B wherein the drilling apparatus has a primary axis, wherein the driveshaft has a driveshaft axis, wherein the driveshaft axis is oblique to the primary axis, wherein the primary axis and the driveshaft axis intersect at an axis intersection point, and wherein the axis intersection point is axially located between the proximal bearing housing end and the distal bearing housing end.

Embodiment D

The drilling apparatus of Embodiment C wherein the bearing housing comprises an angular offset and wherein the angular offset causes the driveshaft axis to be oblique to the primary axis.

Embodiment E

The drilling apparatus of any one of Embodiments A through D wherein the bearing assembly comprises a first bearing comprising a stationary first bearing component, and wherein the bearing assembly comprises a first sleeve which is non-rotatably engaged with the bearing housing and which is non-rotatably engaged with the stationary first bearing component so that the stationary first bearing component is non-rotatable relative to the bearing housing.

Embodiment F

The drilling apparatus of Embodiment E wherein the first sleeve and the bearing housing comprise complementary engagement surfaces for non-rotatably engaging the first sleeve with the bearing housing, and wherein the first sleeve and the stationary first bearing component comprise complementary engagement surfaces for non-rotatably engaging the first sleeve with the stationary first bearing component.

Embodiment G

The drilling apparatus of any one of Embodiments E or F wherein the bearing assembly comprises a second bearing comprising a stationary second bearing component, and wherein the bearing assembly comprises a second sleeve which is non-rotatably engaged with the bearing housing and which is non-rotatably engaged with the stationary second bearing component so that the stationary second bearing component is non-rotatable relative to the bearing housing.

Embodiment H

The drilling apparatus of Embodiment G wherein the first sleeve and the bearing housing comprise complementary engagement surfaces for non-rotatably engaging the first sleeve with the bearing housing, and wherein the first sleeve and the stationary first bearing component comprise complementary engagement surfaces for non-rotatably engaging the first sleeve with the stationary first bearing component, wherein the second sleeve and the bearing housing comprise complementary engagement surfaces for non-rotatably engaging the second sleeve with the bearing housing, and wherein the second sleeve and the stationary second bearing component comprise complementary engagement surfaces for non-rotatably engaging the second sleeve with the stationary second bearing component.

Embodiment I

The drilling apparatus of any one of Embodiments E or F wherein the bearing assembly comprises a third bearing comprising a stationary third bearing component, and wherein the first sleeve is non-rotatably engaged with the stationary third bearing component so that the stationary third bearing component is non-rotatable relative to the bearing housing.

Embodiment J

The drilling apparatus of Embodiment I wherein the first sleeve and the bearing housing comprise complementary engagement surfaces for non-rotatably engaging the first sleeve with the bearing housing, wherein the first sleeve and the stationary first bearing component comprise complementary engagement surfaces for non-rotatably engaging the first sleeve with the stationary first bearing component, and wherein the first sleeve and the stationary third bearing component comprise complementary engagement surfaces for non-rotatably engaging the first sleeve with the stationary third bearing component.

Embodiment K

The drilling apparatus of any one of Embodiments G or H wherein the bearing assembly comprises a third bearing comprising a stationary third bearing component, and wherein the first sleeve is non-rotatably engaged with the stationary third bearing component so that the stationary third bearing component is non-rotatable relative to the bearing housing.

Embodiment L

The drilling apparatus of Embodiment K wherein the first sleeve and the bearing housing comprise complementary engagement surfaces for non-rotatably engaging the first sleeve with the bearing housing, wherein the first sleeve and the stationary first bearing component comprise complementary engagement surfaces for non-rotatably engaging the first sleeve with the stationary first bearing component, wherein the first sleeve and the stationary third bearing component comprise complementary engagement surfaces for non-rotatably engaging the first sleeve with the stationary third bearing component, wherein the second sleeve and the bearing housing comprise complementary engagement surfaces for non-rotatably engaging the second sleeve with the bearing housing, and wherein the second sleeve and the stationary second bearing component comprise complementary engagement surfaces for non-rotatably engaging the second sleeve with the stationary second bearing component.

Embodiment M

The drilling apparatus of any one of Embodiments E through L wherein the first bearing is a thrust bearing.

Embodiment N

The drilling apparatus of any one of Embodiments G, H, K or L wherein the first bearing is a thrust bearing and wherein the second bearing is a thrust bearing.

Embodiment O

The drilling apparatus of any one of Embodiments G, H, K or L wherein one of the first bearing and the second bearing is a thrust bearing and wherein the other of the first bearing and the second bearing is a radial bearing.

Embodiment P

The drilling apparatus of any one of Embodiments I through L wherein one of the first bearing and the third bearing is a thrust bearing and wherein the other of the first bearing and the third bearing is a radial bearing.

Embodiment Q

The drilling apparatus of any one of Embodiments I through L wherein one of the first bearing and the third bearing is a thrust bearing and wherein the other of the first bearing and the third bearing is a radial bearing.

Embodiment R

The drilling apparatus of any one of Embodiments G, H, K or L wherein the second bearing is a thrust bearing.

Embodiment S

The drilling apparatus of any one of Embodiments G, H, K or L wherein the second bearing is a thrust bearing.

Embodiment T

The drilling apparatus of any one of Embodiments A through S wherein the drilling apparatus is a drilling motor for use in drilling a borehole.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

We claim:

1. A drilling apparatus comprising a drive section and a bearing section axially distal to the drive section, wherein the drilling apparatus has a primary axis, and wherein the bearing section comprises:

(a) a unitary bearing housing having a proximal bearing housing end, a distal bearing housing end, and defining a bearing housing bore, wherein the bearing housing comprises an angular offset;

(b) a driveshaft received within the bearing housing bore, wherein the driveshaft is rotatable relative to the bearing housing, wherein the driveshaft has a driveshaft axis, wherein the driveshaft axis is oblique to the primary axis, wherein the primary axis and the driveshaft axis intersect at an axis intersection point, wherein the axis intersection point is axially located between the proximal bearing housing end and the distal bearing housing end, and wherein the angular offset causes the driveshaft axis to be oblique to the primary axis; and (c) a bearing assembly radially interposed between the bearing housing and the driveshaft, for rotatably supporting the driveshaft within the bearing housing bore.

2. The drilling apparatus as claimed in claim 1 wherein the drilling apparatus comprises a transmission section axially interposed between the drive section and the bearing section, wherein the transmission section comprises a transmission housing, wherein the transmission housing has a distal transmission housing end, and wherein the distal transmission housing end is connected directly with the proximal bearing housing end so that the transmission housing is connected directly with the bearing housing.

3. The drilling apparatus as claimed in claim 1 wherein the bearing assembly comprises a first bearing comprising a stationary first bearing component, and wherein the bearing assembly comprises a first sleeve which is non-rotatably engaged with the bearing housing and which is non-rotatably engaged with the stationary first bearing component so that the stationary first bearing component is non-rotatable relative to the bearing housing.

4. The drilling apparatus as claimed in claim 3 wherein the first sleeve and the bearing housing comprise complementary engagement surfaces for non-rotatably engaging the first sleeve with the bearing housing, and wherein the first sleeve and the stationary first bearing component comprise complementary engagement surfaces for non-rotatably engaging the first sleeve with the stationary first bearing component.

5. The drilling apparatus as claimed in claim 3 wherein the bearing assembly comprises a second bearing comprising a stationary second bearing component, and wherein the bearing assembly comprises a second sleeve which is non-rotatably engaged with the bearing housing and which is non-rotatably engaged with the stationary second bearing component so that the stationary second bearing component is non-rotatable relative to the bearing housing.

6. The drilling apparatus as claimed in claim 5 wherein the first sleeve and the bearing housing comprise complementary engagement surfaces for non-rotatably engaging the first sleeve with the bearing housing, and wherein the first sleeve and the stationary first bearing component comprise complementary engagement surfaces for non-rotatably engaging the first sleeve with the stationary first bearing component, wherein the second sleeve and the bearing housing comprise complementary engagement surfaces for non-rotatably engaging the second sleeve with the bearing housing, and wherein the second sleeve and the stationary second bearing component comprise complementary engagement surfaces for non-rotatably engaging the second sleeve with the stationary second bearing component.

7. The drilling apparatus as claimed in claim 5 wherein the bearing assembly comprises a third bearing comprising a stationary third bearing component, and wherein the first sleeve is non-rotatably engaged with the stationary third bearing component so that the stationary third bearing component is non-rotatable relative to the bearing housing.

8. The drilling apparatus as claimed in claim 7 wherein the first sleeve and the bearing housing comprise complementary engagement surfaces for non-rotatably engaging the first sleeve with the bearing housing, wherein the first sleeve and the stationary first bearing component comprise complementary engagement surfaces for non-rotatably engaging the first sleeve with the stationary first bearing component, wherein the first sleeve and the stationary third bearing component comprise complementary engagement surfaces for non-rotatably engaging the first sleeve with the stationary third bearing component, wherein the second sleeve and the bearing housing comprise complementary engagement surfaces for non-rotatably engaging the second sleeve with the bearing housing, and wherein the second sleeve and the stationary second bearing component comprise complementary engagement surfaces for non-rotatably engaging the second sleeve with the stationary second bearing component.

9. The drilling apparatus as claimed in claim 7 wherein one of the first bearing and the third bearing is a thrust bearing and wherein the other of the first bearing and the third bearing is a radial bearing.

10. The drilling apparatus as claimed in claim 9 wherein the second bearing is a thrust bearing.

11. The drilling apparatus as claimed in claim 7 wherein the second bearing is a thrust bearing.

12. The drilling apparatus as claimed in claim 5 wherein the first bearing is a thrust bearing and wherein the second bearing is a thrust bearing.

13. The drilling apparatus as claimed in claim 5 wherein one of the first bearing and the second bearing is a thrust bearing and wherein the other of the first bearing and the second bearing is a radial bearing.

14. The drilling apparatus as claimed in claim 3 wherein the bearing assembly comprises a third bearing comprising a stationary third bearing component, and wherein the first sleeve is non-rotatably engaged with the stationary third bearing component so that the stationary third bearing component is non-rotatable relative to the bearing housing.

15. The drilling apparatus as claimed in claim 14 wherein the first sleeve and the bearing housing comprise complementary engagement surfaces for non-rotatably engaging the first sleeve with the bearing housing, wherein the first sleeve and the stationary first bearing component comprise complementary engagement surfaces for non-rotatably engaging the first sleeve with the stationary first bearing component, and wherein the first sleeve and the stationary third bearing component comprise complementary engagement surfaces for non-rotatably engaging the first sleeve with the stationary third bearing component.

16. The drilling apparatus as claimed in claim 14 wherein one of the first bearing and the third bearing is a thrust bearing and wherein the other of the first bearing and the third bearing is a radial bearing.

17. The drilling apparatus as claimed in claim 3 wherein the first bearing is a thrust bearing.

18. The drilling apparatus as claimed in claim 1 wherein the drilling apparatus is a drilling motor for use in drilling a borehole.

19. A drilling apparatus comprising a drive section and a bearing section axially distal to the drive section, wherein the bearing section comprises:

(a) a unitary bearing housing having a proximal bearing housing end, a distal bearing housing end, and defining a bearing housing bore;

(b) a driveshaft received within the bearing housing bore, wherein the driveshaft is rotatable relative to the bearing housing; and (c) a bearing assembly radially interposed between the bearing housing and the driveshaft, for rotatably supporting the driveshaft within the bearing housing bore, wherein the bearing assembly comprises a first bearing comprising a stationary first bearing component, wherein the bearing assembly comprises a first sleeve which is non-rotatably engaged with the bearing housing and which is non-rotatably engaged with the stationary first bearing component so that the stationary first bearing component is non-rotatable relative to the bearing housing, wherein the bearing assembly comprises a second bearing comprising a stationary second bearing component, wherein the bearing assembly comprises a second sleeve which is non-rotatably engaged with the bearing housing and which is non-rotatably engaged with the stationary second bearing component so that the stationary second bearing component is non-rotatable relative to the bearing housing, wherein one of the first bearing and the second bearing is a thrust bearing, and wherein the other of the first bearing and the second bearing is a radial bearing.

20. A drilling apparatus comprising a drive section and a bearing section axially distal to the drive section, wherein the bearing section comprises:

(a) a unitary bearing housing having a proximal bearing housing end, a distal bearing housing end, and defining a bearing housing bore;

(b) a driveshaft received within the bearing housing bore, wherein the driveshaft is rotatable relative to the bearing housing; and (c) a bearing assembly radially interposed between the bearing housing and the driveshaft, for rotatably supporting the driveshaft within the bearing housing bore, wherein the bearing assembly comprises a first bearing comprising a stationary first bearing component, wherein the bearing assembly comprises a first sleeve which is non-rotatably engaged with the bearing housing and which is non-rotatably engaged with the stationary first bearing component so that the stationary first bearing component is non-rotatable relative to the bearing housing, wherein the bearing assembly comprises a third bearing comprising a stationary third bearing component, wherein the first sleeve is non-rotatably engaged with the stationary third bearing component so that the stationary third bearing component is non-rotatable relative to the bearing housing, wherein one of the first bearing and the third bearing is a thrust bearing, and wherein the other of the first bearing and the third bearing is a radial bearing.

21. A drilling apparatus comprising a drive section and a bearing section axially distal to the drive section, wherein the bearing section comprises:

(a) a unitary bearing housing having a proximal bearing housing end, a distal bearing housing end, and defining a bearing housing bore;

(b) a driveshaft received within the bearing housing bore, wherein the driveshaft is rotatable relative to the bearing housing; and (c) a bearing assembly radially interposed between the bearing housing and the driveshaft, for rotatably supporting the driveshaft within the bearing housing bore, wherein the bearing assembly comprises a first bearing comprising a stationary first bearing component, wherein the bearing assembly comprises a first sleeve which is non-rotatably engaged with the bearing housing and which is non-rotatably engaged with the stationary first bearing component so that the stationary first bearing component is non-rotatable relative to the bearing housing, wherein the bearing assembly comprises a second bearing comprising a stationary second bearing component, wherein the bearing assembly comprises a second sleeve which is non-rotatably engaged with the bearing housing and which is non-rotatably engaged with the stationary second bearing component so that the stationary second bearing component is non-rotatable relative to the bearing housing, wherein the bearing assembly comprises a third bearing comprising a stationary third bearing component, wherein the first sleeve is non-rotatably engaged with the stationary third bearing component so that the stationary third bearing component is non-rotatable relative to the bearing housing, wherein one of the first bearing and the third bearing is a thrust bearing, and wherein the other of the first bearing and the third bearing is a radial bearing.

22. The drilling apparatus as claimed in claim 21 wherein the second bearing is a thrust bearing.

* * * * *